United States Patent [19]

Colclough et al.

[11] Patent Number: 4,867,890

[45] Date of Patent: Sep. 19, 1989

[54] LUBRICATING OIL COMPOSITIONS CONTAINING ASHLESS DISPERSANT, ZINC DIHYDROCARBYLDITHIOPHOSPHATE, METAL DETERGENT AND A COPPER COMPOUND

[76] Inventors: Terence Colclough, 23 Tatham Rd., Abingdon, Oxfordshire; Frederick A. Gibson, 64 Penwood Heights, Penwood, Newbury, Burgh Close; John F. Marsh, 1 Valley Close, Goring, Reading, Berkshire, all of United Kingdom

[21] Appl. No.: 49,712

[22] Filed: May 12, 1987

Related U.S. Application Data

[63] Continuation of Ser. No. 900,788, Aug. 27, 1986, abandoned, which is a continuation of Ser. No. 362,114, Mar. 26, 1982, abandoned, which is a continuation of Ser. No. 177,367, Aug. 11, 1980, abandoned.

[30] Foreign Application Priority Data

Aug. 13, 1979 [GB] United Kingdom ..... 7928146

[51] Int. Cl.[4] ..... C10M 141/12

[52] U.S. Cl. ..... 252/327 E; 252/33.4; 252/42.7; 252/47; 252/48.2; 252/49.7; 252/50; 252/51.5 A; 252/56 R

[58] Field of Search ..... 252/327 E, 33.4, 42.7, 252/47, 48.2, 49.7, 50, 51.5 A, 56 R

[56] References Cited

U.S. PATENT DOCUMENTS

| | | | |
|---|---|---|---|
| 2,162,398 | 6/1936 | Haas | 87/9 |
| 2,181,121 | 11/1939 | Downing et al. | 23/250 |
| 2,202,826 | 6/1940 | Brandes | 87/9 |
| 2,252,087 | 8/1941 | McNab | 252/37 |
| 2,255,597 | 9/1941 | Downing et al. | 44/9 |
| 2,279,973 | 4/1942 | Dietrich | 252/51 |
| 2,282,710 | 5/1942 | Dietrich | 252/47 |
| 2,285,878 | 6/1942 | White et al. | 252/51 |
| 2,305,627 | 12/1942 | Lincoln et al. | 252/54 |
| 2,316,079 | 4/1943 | Loane et al. | 252/48 |
| 2,316,082 | 4/1943 | Loane et al. | 252/48 |
| 2,316,083 | 4/1943 | Loane et al. | 252/48 |
| 2,316,084 | 4/1943 | Loane et al. | 252/48 |
| 2,316,086 | 4/1943 | MacLaren | 252/48 |
| 2,316,088 | 4/1943 | Loane et al. | 252/48 |
| 2,326,938 | 8/1943 | Fuller et al. | 252/51 |
| 2,343,756 | 3/1944 | Downing et al. | 252/37 |
| 2,349,820 | 5/1944 | Fox | 252/43 |
| 2,352,164 | 6/1944 | Burnham et al. | 252/51 |
| 2,352,462 | 6/1944 | Weiss et al. | 252/51 |
| 2,355,257 | 3/1944 | Badertscher | 252/51 |
| 2,356,661 | 8/1944 | Downing et al. | 252/37 |
| 2,361,339 | 10/1944 | White et al. | 252/51 |
| 2,364,283 | 3/1944 | Freuler | 252/37 |
| 2,364,284 | 3/1944 | Freuler | 252/39 |
| 2,373,021 | 4/1945 | Downing et al. | 44/74 |
| 2,381,952 | 8/1945 | Gubelmann | 44/73 |
| 2,394,954 | 2/1946 | Watkins | 252/47.5 |
| 2,407,265 | 9/1946 | Fox | 260/428 |
| 2,458,425 | 3/1949 | Rocchini | 252/33.6 |

(List continued on next page.)

FOREIGN PATENT DOCUMENTS

| | | |
|---|---|---|
| 0263703 | 4/1988 | European Pat. Off. . |
| 667579 | of 1976 | U.S.S.R. . |
| 879991 | of 0000 | United Kingdom . |
| 779825 | of 1957 | United Kingdom . |
| 799037 | 7/1958 | United Kingdom . |
| 846857 | of 1960 | United Kingdom . |

OTHER PUBLICATIONS

Ind. Eng. Chem. 35, 581–588 (1943), R. G. Larsen et al.

J. H. T. Brook, et al., "Iron and Copper as Catalysts in the Oxidation of Hydrocarbon Lubricating Oils", Discussions of Faraday Society 1951, 10, 298–307.

(List continued on next page.)

*Primary Examiner*—William R. Dixon, Jr.

*Assistant Examiner*—Jerry D. Johnson

[57] ABSTRACT

A lubricating oil composition having improved properties comprises a major proportion by weight of a lubricating oil, a dispersant compound, from 0.01 to 0.5 wt % phosphorus and zinc and 5 to 500 parts per million of copper, and additive concentrates for blending with oil to produce such lubricating oil compositions.

82 Claims, 3 Drawing Sheets

U.S. PATENT DOCUMENTS

| | | | |
|---|---|---|---|
| 2,500,195 | 3/1950 | McDermott | 260/429 |
| 2,529,303 | 11/1950 | McDermott | 252/32.7 |
| 2,552,570 | 5/1951 | McNab et al. | 252/32.7 E |
| 2,560,542 | 7/1951 | Bartelson et al. | 252/32.7 |
| 2,567,023 | 9/1951 | Morway et al. | 260/399 |
| 2,618,597 | 11/1952 | McNab et al. | 252/32.7 E |
| 2,699,427 | 1/1955 | Smith et al. | 252/33.6 |
| 2,737,492 | 3/1956 | Beegle et al. | 252/32.7 |
| 2,798,880 | 7/1957 | Williams et al. | 260/438 |
| 2,813,016 | 11/1957 | Edelman | 257/32.7 E |
| 2,958,660 | 11/1960 | Edgar et al. | 252/33.4 |
| 2,958,662 | 11/1960 | Edgar et al. | 252/40.7 |
| 3,014,940 | 12/1961 | Lynch et al. | 260/429 |
| 3,089,850 | 5/1963 | McConnell et al. | 252/32.7 |
| 3,210,275 | 10/1965 | Durr | 252/32.7 |
| 3,271,310 | 3/1966 | Lesuer | 252/35 |
| 3,290,347 | 12/1966 | Meinhardt | 252/325 |
| 3,291,817 | 12/1966 | Rockett | 260/429.9 |
| 3,306,908 | 2/1967 | Lesuer | 260/326 |
| 3,322,802 | 5/1967 | Brooks et al. | 260/429 |
| 3,351,647 | 11/1967 | Butler et al. | 260/429.9 |
| 3,360,463 | 12/1967 | Jacques et al. | 252/32.7 |
| 3,376,221 | 4/1968 | Butler | 252/32.7 |
| 3,401,185 | 9/1968 | Meinhardt | 260/429.9 |
| 3,412,118 | 11/1968 | Kujawa et al. | 260/429 |
| 3,422,014 | 1/1969 | Forbes et al. | 252/37 |
| 3,423,316 | 1/1969 | Dickert et al. | 252/32.7 |
| 3,509,052 | 4/1970 | Murphy | 252/34.7 |
| 3,522,179 | 7/1970 | Lesuer | 252/51.5 |
| 3,523,081 | 8/1970 | Braid | 252/32.7 |
| 3,532,626 | 10/1970 | Rowe | 252/32.7 |
| 3,632,510 | 1/1972 | Lesuer | 252/35 |
| 3,649,661 | 3/1972 | Otto et al. | 260/429 |
| 3,701,729 | 10/1972 | Fischer et al. | 252/1 |
| 3,714,042 | 1/1973 | Greenough | 252/33.2 |
| 3,791,805 | 12/1974 | Brannen et al. | 44/68 |
| 3,796,662 | 3/1974 | Lyle et al. | 252/32.7 E |
| 3,798,165 | 3/1974 | Piasek | 252/51.5 R |
| 3,843,536 | 10/1974 | Johnston | 252/51.5 R |
| 3,933,659 | 1/1976 | Lyle et al. | 252/32.7 E |
| 4,035,306 | 7/1977 | Brois | 252/49.7 |
| 4,100,082 | 7/1978 | Clason | 252/33.4 |
| 4,110,234 | 8/1978 | Loveless | 252/47.5 |
| 4,175,043 | 11/1979 | Horodysky | 252/32.7 E |
| 4,225,448 | 9/1980 | Braid | 252/51.5 |
| 4,234,435 | 9/1980 | Meinhardt et al. | 252/49.7 |
| 4,292,186 | 9/1981 | Chibnik et al. | 252/49.7 |
| 4,308,154 | 12/1981 | Clason et al. | 252/32.7 |
| 4,390,437 | 6/1983 | Lee et al. | 252/51.5 A |
| 4,417,990 | 11/1983 | Clason et al. | 252/32.7 |
| 4,502,970 | 3/1985 | Schetelich et al. | 252/32.7 E |

OTHER PUBLICATIONS

R. R. Kuhn, "The Development of a Lube Oil Oxidation and Thickening Bench Test to Simulate the ASTM Sequence IIIC Engine Test", ACS Chicago Meeting, Aug. 26–31, 1973, 694–705.

SAE Standard J183, Jun. 1986.

S. W. Harris, et al., "Analysis of the PV-1 Test Via Used Oils", ASLE Lubrication Engineering, 38, 8, 487–496 (1982).

J. S. Ashford, et al., "The Thermal Decomposition of Zinc Di-(4-Methylpentyl-2) Dithiophosphate", J. Appl. Chem., 15, 170–178 (1965).

W. M. Denton et al., "Screening of Compounds for Anti-Oxidant Activity in Motor Oil", IP Review, 46–54 (1966).

S. K. Ivanov et al., *Petroleum and Coal-Natural Gas-Petrochemistry Associated with Fuel Chemistry,* vol. 24, No. 8, Aug. 1971, "Investigation of the Influence of the Metal Atoms in the Molecule of the Dithiophosphate on their Inhibiting Properties in the Self-Oxidation etc.".

R. G. Bossert, *Journal of Chemical Education,* Jan. 1950, pp. 10–15, "The Metallic Soaps".

P. I. Sanin et al., *Acta Chim. Hung.,* 1963, pp. 382–389, "Metal Dialkyldithiophosphates as Antioxidants", Pet. Institute of the Academy of Sciences of the USSR, Moscow.

Mostecky et al., *Sb. Vys. Sk. Chem.-Technol. Praze* (1972) D. 26, "Measurement of the Antioxidant Properties of Zinc 0,0[1] Dialkyl Dithiophosphates", D.26, 23–42.

Chenier et al., *Can. J. Chem.,* vol. 56, 157–163 (1977), "Metal Complexes as Antioxidants".

Chenier et al., *Can. J. Chem.,* vol. 55, 1644–1652 (1977), "Metal Complexes as Antioxidants".

A. J. Burn, *Tetrahedron,* vol. 22, 2153–2161 (1966), "The Mechanism of the Antioxidant Action of Zinc Dialkyl Dithiophosphates".

*The Merck Index,* An Encyclopedia of Chemicals and Drugs, Ninth Edition, Merck & Co., Inc. 1976, p. 344.

"Sequence IID Test Oil Precision Data", ASTM Se- (List continued on next page.)

OTHER PUBLICATIONS quence IIID Surveillance Panel Report, Dec. 9, 1986, Savannah, Georgia.

T. Colclough et al., "Oxidation of Organic Sulfides," J. Org. Chem., pp. 4790–4793 (1964).

B. F. Downing et al., "Effect of Engine Metals on the Deterioration of Motor Oil," Oil and Gas J., pp. 70, 72, 75 (Jun. 15, 1939).

M. R. Fenske, et al, "Oxidation of Lubricating Oils, Factors Controlling Oxidation Stability," Ind. & Eng. Chem., vol. 33, No. 4, pp. 316–324 (1941).

VonHorst Luther et al., Erdol und Kohle- Erdgas-Petrolchemie, 22. Jarg., Sep. 1969, pp. 530–536 (German, English translation not available).

M. L. McMillan et al., "Viscosity Effects on Engine Wear Under High-Temperature High-Speed Conditions," SAE Papers No. 780982 (1978).

C. V. Smalheer, et al., "Lubricant Additives", p. 6 (Lezius-Hiles Co. 1967).

J. B. Stemniski et al., "Antioxidants for High-Temperature Lubricants," ASLE Transactions, vol. 7, pp. 43–54 (1964).

J. R. Wasson, "Complexes with Sulfur and Selenium Donors, . . . Copper (II) Chelates," Inorg. Chem., vol. 10, No. 10, pp. 1531–1534 (1971).

LUBRICATING OIL COMPOSITIONS CONTAINING ASHLESS DISPERSANT, ZINC DIHYDROCARBYLDITHIOPHOSPHATE, METAL DETERGENT AND A COPPER COMPOUND

REFERENCE TO RELATED APPLICATIONS

This application is a rule continuation of Ser. No. 900,788, filed 8/27/86now abandoned; which is a rule 60 continuation of Ser. No. 362,114, filed 3/26/82; which is a Rule 60 continuation of Ser. No. 177,367, filed 8/11/80; which is based on U.K. No. 79-28146, filed 8/13/79.

The present invention relates to lubricating compositions, especially crankcase lubricants for automobiles and trucks, containing copper in an amount sufficient to retard or inhibit oxidation of the lubricant during use, without interfering with the function of other components of the lubricant composition.

There is currently a great need to improve the efficiency and useful life of lubricants, particularly those used as crankcase lubricants in internal combustion engines in automobiles and trucks. Limited oil resources and rapidly increasing prices for crude oil have made it imperative to obtain a longer useful life from oil-based products.

One of the factors which substantially shortens the life of lubricating compositions is oxidation of the oil component. Oxidation results in increased acidity of the lubricant, leading to greater corrosion of engine parts and undesirably increased viscosity, which degrades its lubricant qualities.

While high quality oil, itself, is relatively resistant to oxidation, contaminants, such as iron, which inevitably are present in internal combustion engines and common lubricant additives, such as magnesium and calcium detergents and polyisobutenyl succinic acid/polyamine or polyester dispersants, have the undesirable effect of greatly accelerating the oxidation process, to the extent that oxidation is one of the major contributors to reduced lubricant life. In addition, there has been an increasing need to utilize lower quality lubricating oil basestocks, as oil fields producing the higher quality oils are depleted. These lower quality oil basestocks exhibit a greater tendency to oxidize.

Therefore, effective inhibition or retardation of oxidation is important in obtaining the maximum life from a lubricant composition and has become more important as demands increase for longer intervals between oil changes, to reduce oil consumption and to lessen the environmental impact resulting from disposal of large volumes of used oil.

It has been known for some time that some compounds have the ability to inhibit or retard oxidation when incorporated into the lubricating composition. For example, hindered phenols and sulphurised phenols have been used for that purpose and zinc dialkyldithiophosphates, which are primarily anti-wear agents, as well as providing antioxidant activity. The known agents are typically used in large amounts in order to obtain the desired effect, which increases the cost of the composition and, in the case of zinc dialkyldithiophosphate, produces an undesirably high level of phosphorus in the oil. Even in such large amounts, adequate antioxidant performance may not be achieved when the composition contains other additives which can be oxidation promoters. Moreover, modern lubricants are complex mixtures of various additives, each serving a particular purpose. For example, they may contain one or more viscosity modifiers, detergents, dispersants, antacids, corrosion inhibitors, anti-rust agents and anti-wear agents, for protecting and promoting the efficiency of the engine in which the composition is used. An effective antioxidant should retard oxidation of the lubricant but without interfering with the function of others additives and without contributing undesirable contaminants. Obviously, extending the life of the lubricant through retardation of oxidation would be of no value if it were accompanied by damage to the engine, by increased corrosion or wear.

Figure 1:
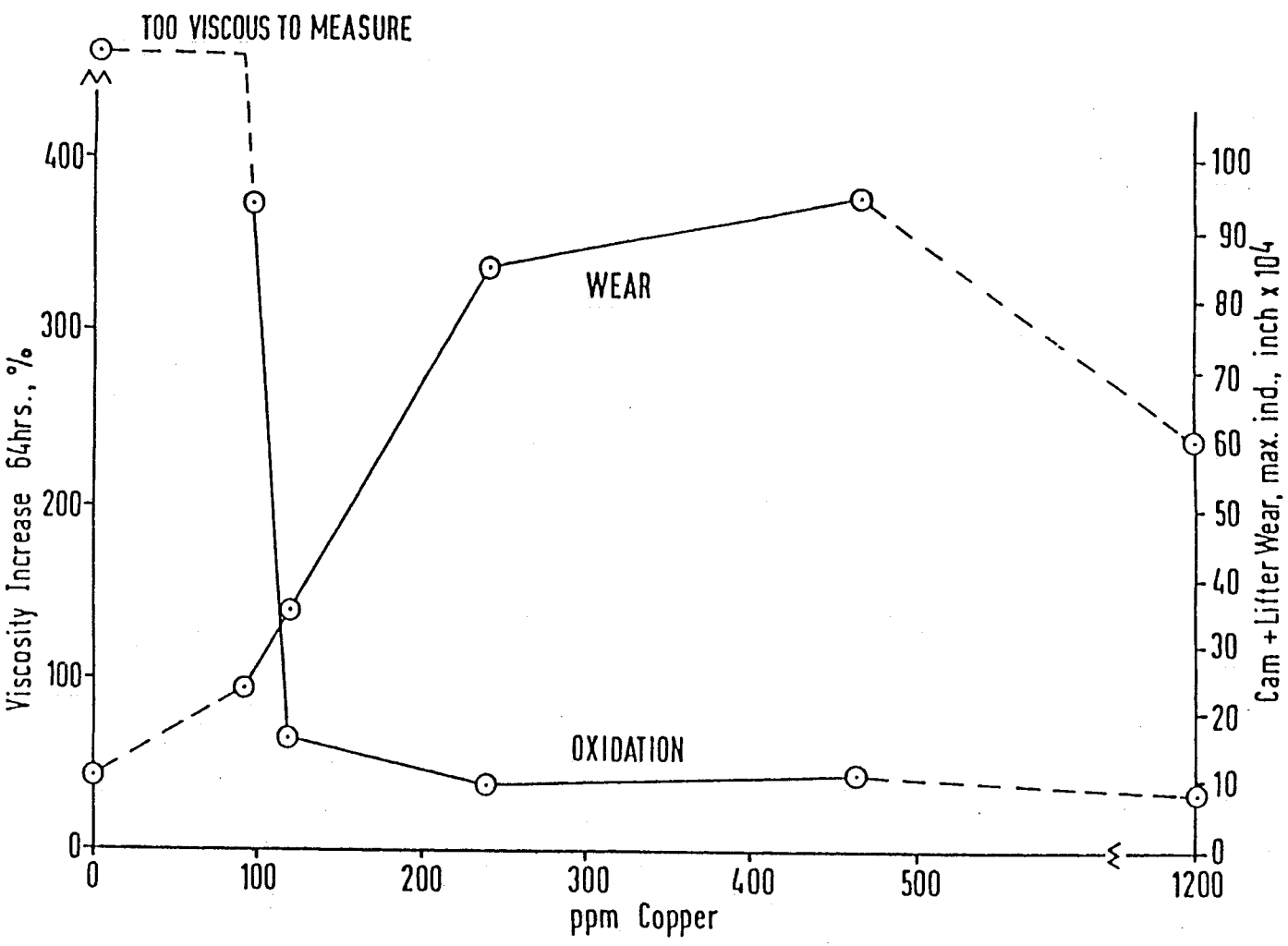
FIG. 1 is a graphical plot of the increase in oil composition viscosity and of the wear of the cam and lifters against the part per million of copper in the oil compositions of Example 2.

In accordance with the present invention, it is possible to retard or inhibit oxidation of a lubricant composition containing dispersant and anti-wear additives without adversely affecting the performance of those additives, by incorporating in the lubricant composition an oil-soluble copper compound, within a specified range of concentrations.

In accordance with its preferred aspects, this invention provides novel, oxidation-stable lubricant compositions comprising a major amount of a lubricating oil, one or more ashless sludge dispersants and/or polymeric viscosity index improver dispersants, one or more zinc dihydrocarbyl dithiophosphates as extreme pressure and anti-wear agents and an oil-soluble copper compound present in the amount of about 5 to about 500 parts per million (ppm) of copper by weight, based on the total composition.

In particularly preferred embodiments of the invention, the lubricant composition will also contain one or more overbased additives which function as antacid and anti-rust agents, such as overbased calcium or magnesium sulfonates or phenates.

The amount of copper compound employed is critical in obtaining the benefits of this invention. At unduly low concentrations, the anti-oxidant effect will not be sufficiently realized. At unduly high concentrations, interference with the performance of the anti-wear additive may occur and a pronounced increase in wear may be observed on high stress points, such as camshafts and lifters. In general, the amount of added copper compound employed will be such to give a copper concentration of about 5 to about 500 ppm by weight of copper in the lubricant composition and preferably about 10 to 200, e.g. 60 to about 200 ppm. The amount of copper compound employed, within the above ranges, will also preferably be correlated with the amount of zinc dihydroxcarbyldithiophosphate, as indicated by the phosphorus concentration.

The ability of the oil-soluble copper compound to function as an anti-oxidant in lubricating compositions is surprising. Copper is known to act, in many cases, as an oxidation promoter or catalyst. Moreover, closely related metals, such as cobalt and chromium are not effective lubricant antioxidants.

It if also surprising that the copper compound functions effectively in compositions which contain other metal compounds, such as zinc dialkyldithiophosphates and calcium or magnesium overbased additives, which might be expected to inactivate it through interchange of the metal components.

The copper anti-oxidants of this invention are inexpensive and are effective at low concentrations and therefore do not add substantially to the cost of the product. The results obtained are frequently better than those obtained with previously used anti-oxidants, which are expensive and used in higher concentrations. In the amounts employed, the copper compounds do not interfere with the performance of other components of the lubricant composition, in many instances, completely satisfactory results are obtained when the copper compound is the sole oxidant in addition to the ZDDP. The copper compounds can be utilized to replace part or all of the need for supplementary antioxidants. Thus, for particularly severe conditions it may be desirable to include a supplementary, conventional antioxidant. However, the amounts of supplementary antioxidant required are small, far less than the amount required in the absence of the copper compound.

There have previously been isolated references to the inclusion of copper compounds in lubricant compositions, but none of those references disclose the composition of the present invention.

U.S. Pat. Nos. 2,343,756 and 2,356,662 disclose the addition of copper compounds, in conjunction with sulfur compounds, to lubricant oils. In U.S. Pat. No. 2,552,570, cuprous thiophosphates are included in lubricant compositions at relatively high levels, which results in undesirably high sulfated ash content. In U.S. Pat. No. 3,346,493, a wide variety of polymeric amine-metal reactants are employed as detergents in lubricant compositions. In the two isolated instances in which the metal is copper and the composition contains zinc dihydrocarbyldithiophosphate, either the amount of copper employed is outside the range of the present invention or it is necessary that the oil insoluble copper compound be complexed with the dispersant. U.S. Pat. No. 3,652,616 discloses a wide variety of polymeric amine-metal reactants for addition to lubricant compositions. U.S Pat. No. 4,122,033 discloses the entire group of transition metal compounds as additives for lubricants.

None of these references discloses the use of copper compounds which are oil soluble per se in the range of 5–500 ppm in conjunction with a zinc dihydrocarbyldithiophosphate and an ashless sludge dispersant or a polymeric viscosity index improver dispersant. None of these references teaches such a composition with the copper either in the complexed form with the dispersant or non-complexed, in the preferred range of 10–200 ppm. None discloses the ability of such a composition to resist oxidation while providing good anti-wear properties and none discloses that such compositions can also include overbased additives without impairment of their oxidation resistance.

The present invention therefore provides a lubricating composition comprising a major amount of a lubricating oil containing a dispersant selected from the group consisting of:

(1) 1 to 10 wt % ashless dispersant compounds, and (2) 0.3 to 10 wt % of a polymeric Viscosity Index improver dispersant, from 0.01 to 0.5 wt % phosphorus, from 0.01 to 0.5 wt % of zinc all of said weight per cent being based on the weight of the total weight of lubricating composition, and from 5 to 500, e.g. 60 to 200 parts per million by weight of the composition of added copper (that is copper that is added to the fresh unused lubricating composition, as opposed to any copper contamination that might occur during engine use of the composition due to corrosion or wear of copper containing metal parts) in the form of an oil soluble copper compound as hereinafter described.

The lubricating oil includes the mineral lubricating oils and the synthetic lubricating oils and mixtures thereof. The synthetic oils will include diester oils such as di(2-ethylhexyl) sebacate, azelate and adipate; complex ester oils such as those formed from dicarboxylic acids, glycols and either monobasic acids or monohydric alcohols; silicone oils; sulfide esters; organic carbonates; hydrocarbon oils and other synthetic oils known to the art. The invention is particularly useful in mineral lubricating oils and has the added benefit that it may allow use of base stock oils that have inferior antioxidant properties to those currently used.

The oils of the present invention contain from 0.01 to 0.5 wt % phosphorus and from 0.01 to 0.5 wt % zinc, preferably 0.03 to 0.3 wt %, more preferably 0.04 to 0.14 wt % of phosphorus and zinc, these weight per cents and all subsequent weight percents used herein are based upon the total weight of the lubricant composition or additive concentrate composition. All parts by weight as used herein are based upon 100 parts by weight of the total lubricant or additive concentrate composition unless other specified. The phosphorus and zinc are most conveniently provided by a zinc dihydrocarbyl dithiophosphate. Generally 0.01 to 5 parts, preferably 0.2 to 2.0 parts more preferably 0.5 to 1.5 parts by weight per 100 parts of the lubricating oil composition of a zinc dihydrocarbyldithiophosphate are used.

Zinc dihydrocarbyl dithiophosphates which may be used in the compositions of the present invention may be prepared in accordance with known techniques by first forming a dithiophosphoric acid, usually by reaction of an alcohol or a phenol with $P_2S_5$ and then neutralising the dithiophosphoric acid with a suitable zinc compound.

Mixtures of alcohols may be used including mixtures of primary and secondary alcohols, secondary generally for imparting improved antiwear properties, with primary giving improved thermal stability properties. Mixtures of the two are particularly useful. In general, any basic or neutral zinc compound could be used but the oxides, hydroxides and carbonates are most generally employed. Commercial additives frequently contain an excess of zinc due to use of an excess of the basic zinc compound in the neutralisation reaction.

The zinc dihydrocarbyl dithiophosphates useful in the present invention are oil soluble salts of dihydrocarbyl esters of dithiophosphoric acids and may be represented by the following formula:

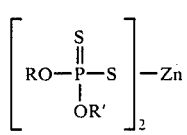

wherein R and R′ may be the same or different hydrocarbyl radicals containing from 1 to 18 and preferably 2 to 12 carbon atoms and including radicals such as alkyl, alkenyl, aryl, aralkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl. sec-butyl, amyl, n-hexyl, i-hexyl, n-heptyl, n-octyl, decyl, dodecyl, octadecyl, 2-ethylhexsyl, phenyl, butylphenyl, cyclohexyl, methylcyclopentyl, propenyl, butenyl etc. In order to obtain oil solubility, the total number of carbon atoms (i.e. R and R') in the dithiophosphoric acid will generally be about 5 or greater.

The copper may be bended into the oil as any suitable oil soluble copper compound, and by oil soluble we mean the compound is soluble under normal blending conditions in the oil or additive package. The copper compound may be in the cuprous or cupric form. The copper may be in the form of the copper dihydrocarbyl thio- or dithio-phosphates wherein copper may be substituted for zinc in the compounds and reactions described above although one mole of cuprous or cupric oxide may be reacted with one or two moles of the dithiophosphoric acid respectively. Alternatively the copper may be added as the copper salt of a synthetic or natural carboxylic acid. Examples include $C_{10}$ to $C_{18}$ fatty acids such as stearic or palmitic, but unsaturated acids such as oleic or branched carboxylic acids such as naphthenic acids of molecular weight from 200 to 500 or synthetic carboxylic acids are preferred because of the improved handling and solubility properties of the resulting copper carboxylates.

Oil soluble copper dithiocarbamates of the general formula $(RR'NCSS)_nCu$ (where n is 1 or 2 and R and R' are the same or different as described above for the zinc dihydrocarbyl dithiophosphate). Copper sulphonates, phenates, and acetyl acetonates may also be used.

We have found that when used in combination with the zinc dialkyl dithiophosphates the quantity of copper in the oil is important to obtaining the combination of antioxidant and antiwear properties needed for extended life lubricants.

We prefer that the lubricant contain 60 to 200, especially 80 to 180 most preferably 90 to 120 although generally it contains from 5 to 500, more preferably 10 to 200, more especially 10 to 180, even more especially 20 to 130 parts per million based on the weight of the lubricant composition. The preferred amount may depend amongst other factors on the quality of the basestock oil.

The lubricating compositions of the present invention may and usually will contain other traditional lubricant additives such as rust inhibitors such as lecithin, sorbitan mono-oleate, dodecyl succinic anhydride or ethoxylated alkyl phenols; pour point depressants such as copolymers of vinyl acetate with fumaric acid esters of coconut oil alcohols; viscosity index improvers such as olefin copolymers, polymethacrylates; etc.

In copper-free oils other antioxidants in addition to the zinc dialkyldithiophosphate are sometimes required to improve the oxidative stability of the oil. These supplementary antioxidants are included especially when the basestock has poor oxidative stability; and typically the supplementary antioxidant is added to the oil in amounts from 0.5–2.5 wt %. The supplementary antioxidants that are used include phenols, hindered-phenols, bis-phenols, and sulphurised phenols, catechol, alkylated catechols and sulphurised alkyl catechols, diphenylamine and alkyl diphenylamines, phenyl-1-naphthylamine and its alkylated derivatives, alkyl borates and aryl borates, alkyl phosphites and alkyl phosphates, aryl phosphites and aryl phosphates, O,O,S-trialkyl dithiophosphates, O,O,S-triaryl dithiophosphates and O,O,S-trisubstituted dithiophosphates containing both alkyl and aryl groups.

The inclusion of small amounts of copper generally removes the need for these supplementary antioxidants. It would, however, still be within the scope of our invention that a supplementary antioxidant can be included especially for oils operating under particularly severe conditions where the presence of such supplementary antioxidants may be beneficial.

The prime benefit of our invention is that the use of copper permits replacing part or all of the need for supplementary antioxidants, that is antioxidant in addition to the ZDDP. Frequently, it enables lubricating compositions having the desired antioxidant properties to be obtained with either no additional supplementary antioxidant or with less than normal concentrations, for example with less than 0.5 wt % and frequently less than about 0.3 wt % of the supplementary antioxidant. The presence of small amounts of copper according to our invention has the added advantage that smaller amounts of a zinc dialkyldithiophosphate may be used.

The dispersancy can be provided by a traditional lubricating oil ashless dispersant compounds such as derivatives of long chain hydrocarbon substituted carboxylic acids in which the hydrocarbon groups contains 50 to 400 carbon atoms. These will generally be a nitrogen containing ashless dispersant having a relatively high molecular weight aliphatic hydrocarbon oil solubilising group attached thereto or an ester of a succinic acid/anhydride with a high molecular weight aliphatic hydrocarbon attached thereto and derived from monohydric and polyhydric alcohols, phenols and naphthols.

The nitrogen containing dispersant additives are those known in the art as sludge dispersants for crankcase motor oils. These dispersants include mineral oil-soluble salts, amides, imides, oxazolines and esters of mono- and dicarboxylic acids (and where they exist the corresponding acid anhydrides) of various amines and nitrogen containing materials having amino nitrogen or hetercyclic nitrogen and at least one amido or hydroxy group capable of salt, amide, imide, oxazoline or ester formation. Other nitrogen containing dispersants which may be used in this invention include those wherein a nitrogen containing polyamine is attached directly to the long chain aliphatic hydrocarbon as shown in U.S. Pat. Nos. 3,275,554 and 3,565,804 where the halogen group on the halogenated hydrocarbon is displaced with various alkylene polyamines.

Another class of nitrogen containing dispersants which may be used are those containing Mannich base or Mannich condensation products as they are known in the art. Such Mannich condensation products generally are prepared by condensing about 1 mole of an alkyl substituted phenol with about 1 to 2.5 moles of formaldehyde and about 0.5 to 2 moles polyalkylene polyamine as disclosed, e.g. in U.S. Pat. No. 3,442,808. Such Mannich condensation products may include a long chain, high molecular weight hydrocarbon on the phenol group or may be reacted with a compound containing such a hydrocarbon, e.g. alkenyl succinic anhyride as shown in said aforementioned U.S. Pat. No. 3,442,808.

Monocarboxylic acid dispersants have been described in U.K. patent Specification 983,040. Here, the high molecular weight monocarboxylic acid can be derived from a polyolefin, such as polyisobutylene, by oxidation with nitric acid or oxygen; or by addition of halogen to the polyolefin followed by hydrolyzing and oxidation. Another method is taught in Belgian Pat. No. 658,236 where polyolefins, such as polymers of $C_2$ to $C_5$ monoolefin, e.g. polypropylene or polyisobutylene, are halogenated, e.g. chlorinated, and then condensed with an alpha-beta-unsaturated, monocarboxylic acid of from 3 to 8, preferably 3 to 4, carbon atoms, e.g. acrylic acid, alphamethyl-acrylic acid, etc. Esters of such acids, e.g. ethyl methacrylate, may be employed if desired in place of the free acid.

The most commonly used dicarboxylic acid is alkenyl succinic anhydride wherein the alkenyl group contains about 50 to about 400 carbon atoms.

Primarily because of its ready availability and low cost, the hydrocarbon portion of the mono- or dicarboxylic acid or other substituted group is preferably derived from a polymer of a $C_2$ to $C_5$ monoolefin, said polymer generally having a molecular weight of about 700 to about 5000. Particularly preferred is polyisobutylene.

Polyalkyleneamines are usually the amines used to make the dispersant. These polyalkyleneamines include those represented by the general formula:

$$H_2N(CH_2)_n—[NH(CH_2)_n]_m—NH(CH_2)_nNH_2$$

wherein n is 2 or 3, and m is o to 10. Examples of such polyalkyleneamines include diethylene triamine, tetraethylene pentamine, octaethylene nonamine, tetrapropylene pentamine, as well as various cyclic polyalkyleneamines.

Dispersants formed by reacting alkenyl succinic anhydride, e.g. polyisobutenyl succinic anhydride and an amine are described in U.S. Pat. Nos. 3,202,678, 3,154,560, 3,172,892, 3,024,195, 3,024,237, 3,219,666, 3,216,936 and Belgium Pat. No. 662,875.

Alternatively the ashless dispersants may be esters derived from any of the aforesaid long chain hydrocarbon substituted carboxylic acids and from hydroxy compounds such as mouohydric and polyhydric alcohols or aromatic compounds such as phenols and naphthols etc. The polyhydric alcohols are the most preferred hydroxy compound and preferably contain from 2 to about 10 hydroxy radicals, for example, ethylene glycol, diethylene glycol, triethylene glycol, tetraethylene glycol, diproplyene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol.

The ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding the esters of this invention comprise the ether-alcohols and amino-alcohols including, for example, the oxy-alkylene, oxy-arylene-, amino alkylene-, and amino-arylene-substituted alcohols having one or more oxy-alkylene, amino-alkylene or aminoarylene oxy-arylene radicals. They are exemplified by Cellosolve, Carbitol, N,N,N',N'-tetrahydroxy-trimethylene di-amine. and the like. For the most part, the ether-alcohols having up to about 150 oxy-alkylene radicals in which the alkylene radical contains from 1 to about 8 carbon atoms are preferred.

The ester dispersant may be di-esters of succinic acids or acidic esters, i.e., partially esterified succinic acids; as well as partially esterified polyhydric alcohols or phenols, i.e., esters having free alcohols or phenolic hydroxyl radicals. Mixtures of the above illustrated esters likewise are contemplated within the scope of this invention.

The ester dispersant may be prepared by one of several known methods as illustrated for example in U.S. Pat. No. 3,522,179.

Hydroxyamines which can be reacted with any of the aforesaid long chain hydrocarbon substituted carboxylic acids to form dispersants include 2-amino-l-butanol, 2-amino-2-methyl-1-propanol, p-(beta-hydroxyethyl)-aniline, 2-amino-1-propanol, 3-amino-1-propanol, 2-amino-2-methyl-1, 3-propane-diol, 2-amino-2-ethyl-1, 3-propanediol, N'-(beta-hydroxy-propyl)-N'-(beta-aminoethyl)-piperazine, tris(hydroxmethyl) aminomethane (also known as trismethylolaminomethane), 2-amino-1-butanol, ethanolamine, beta-(beta-hydroxyethoxy)-ethylamine, and the like. Mixtures of these or similar amines can also be employed.

The preferred dispersants are those derived from polyisobutenyl succinic anhydride and polyethylene amines. e.g. tetraethylene pentamine, polyoxyethylene and polyoxypropylene amines, e.g. polyoxypropylene diamine, trismethylolaminomethane and pentaerythritol, and combinations thereof. One particularly preferred dispersant combination involves a combination of (A) polyisobutenyl succinic anhydride with (B) a hydroxy compound, e.g. pentaerythritol, (C) a polyoxyalkylene polyamine, e.g. polyoxypropylene diamine, and (D) a polyalkylene polyamine, e.g. polyethylene diamine and tetraethylene pentamine using about 0.01 to about 4 equivalents of (B) and (D) and about 0.01 to about 2 equivalents of (C) per equivalent of (A) as described in U.S. Pat. No. 3,804,763.

Another preferred dispersant combination involves the combination of (A) polyisobutenyl succinic anhydride with (B) a polyalkylene polyamine, e.g. tetraethylene pentamine, and (C) a polyhydric alcohol or polyhydroxy-substituted aliphatic primary amine, e.g. pentaerythritol or trismethylolaminomethane as described in U.S. Pat. No. 3,632,511.

The alkenyl succinic polyamine type dispersants can be further modified with a boron compound such as boron oxide, boron halides, boron acids and ester of boron acids in an amount to provide about 0.1 to about 10 atomic proportions of boron per mole of the acylated nitrogen compound as generally taught in U.S. Pat. No. 3,087,936 and 3,254,025. Mixtures of dispersants can also be used such as those described in U.S. Pat. No. 4,113,639.

The oils may contain from 1.0 to 10 wt %, preferably 2.0 to 7.0 wt % of these dispersants.

Alternatively the dispersancy may be provided by 0.3 to 10% of a polymeric Viscosity Index improver dispersant.

Examples of suitable Viscosity Index improvers dispersants include:

(a) polymers comprised of $C_4$ to $C_{24}$ unsaturated esters of vinyl alcohol or $C_3$ to $C_{10}$ unsaturated mono- or di-carboxylic acid with unsaturated nitrogen containing monomers having 4 to 20 carbons (b) polymers of $C_2$ to $C_{20}$ olefin with unsaturated $C_3$ to $C_{10}$ mono- or di-carboxylic acid neutralised with amine, hydroxy amine or alcohols (c) polymers of ethylene with a $C_3$ to $C_{20}$ olefin further reacted either by grafting $C_4$ to $C_{20}$ unsaturated nitrogen containing monomers thereon or by grafting an unsaturated acid onto the polymer backbone and then reacting said carboxylic acid groups with amine, hydroxy amine or alcohol.

In these polymers the amine, hydroxy amine or alcohol "mono- or poly-hydric" may be as described above in relation to the ashless dispersants compounds.

It is preferred that the Viscosity Index Improver dispersant have a number average molecular weight range as by vapor phase osmometry, membrane osmometry, or gel permeation chromatography, of 1000 to 2,000,000; preferably 5,000 to 250,000 and most preferably 10,000 to 200,000. It is also preferred that the polymers of group (a) comprise a major weight amount of unsaturated ester and a minor, e.g. 0.1 to 40 preferably 1 to 20 wt percent of a nitrogen containing unsaturated monomer, said weight percent based on total polymer. Preferably the polymer group (b) comprises 0.1 to 10 moles of olefin preferably 0.2 to 5 moles $C_2$-$C_{20}$ aliphatic or aromatic olefin moieties per mole of unsaturated carboxylic acid moiety and that from 50 percent to 100 percent, of the acid moieties are neutralized. Preferably the polymer of group (c) comprises an ethylene copolymer of 25 to 80 wt percent ethylene with 75 to 20 wt percent $C_3$ to $C_{20}$ mono and/or diolefin, 100 parts by weight of ethylene copolymer being grafted with either 0.1 to 40, preferably 1 to 20 parts by weight unsaturated nitrogen containing monomer, or being grafted with 0.01 to 5 parts by weight of unsaturated $C_3$ to $C_{10}$ mono or dicarboxylic acid, which acid is 50 percent or more neutralized.

The unsaturated carboxylic acids used in (a), (b) and (c) above will preferably contain 3 to 10 more usually 3 or 4 carbon atoms and may be mono carboxylic such as methacrylic and acrylic acids or dicarboxylic such as maleic acid, maleic anhydride, fumaric acid, etc.

Examples of unsaturated esters that may be used include aliphatic saturated mono alcohols of at least 1 carbon atom and preferably of from 12 to 20 carbon atoms such as decyl acrylate, lauryl acrylate, stearyl acrylate, eicosanyl acrylate, docosanyl acrylate, decyl methacrylate, diamyl fumarate, lauryl methacrylate, cetyl methacrylate, stearyl methacrylate, and the like and mixtures thereof.

Other esters include the vinyl alcohol esters of $C_2$ to $C_{22}$ fatty or mono carboxylic acids, preferably saturated such as vinyl acetate, vinyl laurate, vinyl palmitate, vinyl stearate, vinyl oleate. and the like and mixtures thereof.

Examples of suitable unsaturated nitrogen containing monomers containing 4 to 20 carbon atoms which can be used in (a) and (c) above include the amino substituted olefins such as p-(beta-diethylaminoethyl)styrene, basic nitrogen-containing heterocycles carrying a polymerizable ethylenically unsaturated substituent, e.g. the vinyl pyridines and the vinyl alkyl pyridines such as 2-vinyl-5-ethyl pyridine; 2-methyl-5-vinyl pyridine, 2-vinyl-pyridine, 3-vinyl-pyridine, 4-vinyl-pyridine, 3-methyl-5-vinyl-pyridine, 4-methyl-2-vinyl-pyridine, 4-ethyl-2-vinyl-pyridine and 2-butyl-5-vinyl-pyridine and the like.

N-vinyl lactams are also suitable, and particularly when they are N-vinyl pyrrolidones or N-vinyl piperidones. The vinyl radical preferably is unsubstituted ($CH_2=CH-$), but it may be mono-substituted with an aliphatic hydrocarbon group of 1 to 2 carbon atoms, such as methyl or ethyl.

The vinyl pyrrolidones are the preferred class of N-vinyl lactams and are exemplified by N-vinyl pyrrolidone, N-(1-methylvinyl) pyrrolidone, N-vinyl-5-methyl pyrrolidone, N-vinyl-3,3-dimethyl pyrrolidonem, N-vinyl-5-ethyl pyrrolidone, N-vinyl-4-butyl pyrrolidone N-ethyl-3-vinyl pyrrolidone. N-butyl-5-vinyl pyrrolidone, 3-vinyl pyrrolidone, 4-vinyl pyrrolidone, 5-vinyl pyrrolidone and 5-cyclohexyl-N-vinyl pyrrolidone.

Examples of olefins which could be used to prepare the copolymers of (b) and (c) above include mono-olefins such as propylene, 1-butene, 1-pentene, 1-hexene, 1-heptene, 1-decene, 1-dodecene, styrene, etc.

Representative non-limiting examples of diolefins that can be used in (c) include 1,4-hexadiene, 1,5-heptadiene, 1,6-octadiene, 5-methyl-1-4-hexadiene,1,4-cyclohexadiene, 1,5-cyclo-octadiene, vinyl-cyclohexane, dicyclopentenyl and 4,4'-dicyclohexenyl such as tetrahydroindene, methyl tetrahydroindene, dicyclopentadien, bicyclo(2,2,1)hepta-2,5-diene, alkenyl, alkylidiene, 5-methylene-2-norbornene, 5-ethylidene-2-norbornene.

Typical polymeric viscosity index improver-dispersants include copolymers of alkyl methyacrylates with N-vinyl pyrrolidone or dimethylaminoalkyl methacrylate, alkyl fumaratevinyl acetate N-vinyl pyrollidine copolymers, post-grafted interpolymers of ethylene-propylene with an active monomer such as maleic anhydride which may be further reacted with an alcohol or an alkylene polyamine, e.g. see U.S. Pat. Nos. 4,089,794, 4,160,739, 4,137,185; or copolymers of ethylene and propylene reacted or grafted with nitrogen compounds such as shown in U.S. Pat. Nos. 4,068,056, 4,068,058, 4,146,489, 4,149,984; styrene/maleic anhydride polymers post-reacted with alcohols and amines, ethoxylated derivatives of acrylate polymers, for example, see U.S. Pat. No. 3,702,300.

Magnesium and calcium containing additives are frequently included in lubricating compositions. These may be present for example as the metal salts of sulphonic acids, alkyl phenols, sulphurised alkyl phenols, alkyl salicylates, naphthenates, and other oil soluble mono- and di-carboxylic aids.

The highly basic alkaline earth metal sulfonates are usually produced by heating a mixture comprising an oil-soluble alkaryl sulfonic acid with an excess of alkaline earth metal compound above that required for complete neutralization of the sulfonic and thereafter forming a dispersed carbonate complex by reacting the excess metal with carbon dioxide to provide the desired overbasing. The sulfonic acids are typically obtained by the sulfonation of alkyl substituted aromatic hydrocarbons such as those obtained from the fractionation of petroleum by distillation and/or extraction or by the alkylation of aromatic hydrocarbons as for example those obtained by alkylating benzene. toluene, xylene, naphthalene, diphenyl and the halogen derivatives such as chlorobenzene, chlorotoluene and chloronaphthalene. The alkylation may be carried out in the presence of a catalyst with alkylating agents having from about 3 to more than 30 carbon atoms such as for example haloparaffins, olefins that may be obtained by dehydrogenation of paraffins. polyolefins as for example polymers from ethylene, propylene, etc. The alkaryl sulfonates usually contain from about 9 to about 70 or more carbon atoms, preferably from about 16 to about 50 carbon atoms per alkyl substituted aromatic moiety.

The alkaline earth metal compounds which may be used in neutralizing these alkaryl sulfonic acids to provide the sulfonates includes the oxides and hydroxides, alkoxides, carbonates, carboxylate, sulfide, hydrosulfide, nitrate, borates and ethers of magnesium, calcium, and barium. Examples are calcium oxide, calcium hydroxide, magnesium acetate and magnesium borate. As noted, the alkaline earth metal compound is used in excess of that required to complete neutralization of the alkaryl sulfonic acids. Generally, the amount ranges from about 100 to 220%, although it is preferred to use at least 125%, of the stoichiometric amount of metal required for complete neutralization. The preparation of highly basic alkaline earth metal alkaryl sulfonates are generally known as earlier indicated such as in U.S. Pat. Nos. 3,150,088 and 3,150,089 wherein overbasing is accomplished by hydrolysis of the alkoxide-carbonate complex with the alkaryl sulfonate in a hydrocarbon solvent-diluent oil. It is preferable to use such a hydrocarbon so diluent oil for the volatile by-products can be readily removed leaving the rust inhibitor additive in a carrier, e.g. Solvent 150N lubricating oil, suitable for blending into the lubricating oil composition. For the purposes of this invention, a preferred alkaline earth sulfonate is magnesium alkyl aromatic sulfonate having a total base number ranging from about 300 to about 400 with the magnesium sulfonate content ranging from about 25 to about 32 wt % based upon the total weight of the additive system dispersed in Solvent 150 Neutral Oil.

Polyvalent metal alkyl salicylate and naphthenate materials are known additives for lubricating oil compositions to improve their high temperature performance and to counteract deposition of carbonaceous matter on pistons (U.S. Pat. No. 2,744,069). An increase in reserve basicity of the polyvalent metal alkyl salicylates and naphthenates can be realized by utilizing alkaline earth metal, e.g. calcium, salts of mixtures of $C_8$-$C_{26}$ alkyl salicylates and phenates (see U.S. Pat. No. 2,744,069) or polyvalent metal salts of alkyl salicyclic acids, said acids obtained from the alkylation of phenols followed by phenation, carboxylation and hydroylsis (U.S. Pat. No. 3,704,315) which could then be converted into highly basic salts by techniques generally known and used for such conversion. The reserve basicity of these metal-containing rust inhibitors is usefully at TBN levels of between about 60 and 150. Included with the useful polyvalent metal salicylate and naphthenate materials are the methylene and sulfur bridged materials which are readily derived from alkyl substituted salicylic or naphthenic acids or mixtures of either or both with alkyl substituted phenols. Basic sulfurized salicylates and a method for their preparation is shown in U.S. Pat. No. 3,595,791.

For purposes of this disclosure the salicylate/naphthenate rust inhibitors are the alkaline earth (particularly magnesium, calcium, strontium and barium) salts of the aromatic acids having the general formula:

$$HOOC\text{-}ArR_1\text{-}Xy(ArR_1OH)_n$$

where Ar is an aryl radical of 1 to 6 rings, $R_1$ is an alkyl group having from about 8 to 50 carbon atoms, preferably 12 to 30 carbon atoms (optimally about 12), X is a sulfur (—S—) or methylene (—$CH_2$—) bridge, y is a number from 0 to 4 and n is a number irom 0 to 4.

Preparation of the overbased methylene bridged salicylatephenate salt is readily carried out by conventional techniques such as by alkylation of a phenol followed by phenation, carboxylation, hydrolysis, methylene bridging a coupling agent such as an alkylene dihalide followed by salt formation concurrent with carbonation. An overbased calcium salt of a methylene bridged phenol-salicylic acid of the general formula:

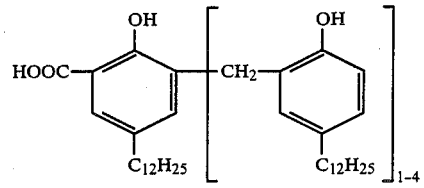

with a TBN of 60 to 150 is representative of a rust-inhibitor highly useful in this invention.

The sulfurized metal phenates can be considered the "metal salt of a phenol sulfide" which thus refers to a metal salt, whether neutral or basic, of a compound typified by the general formula:

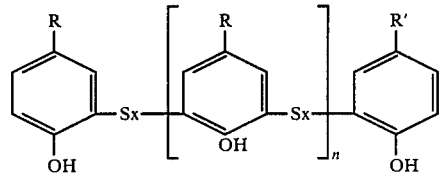

where x=1 or 2 n=0, 1 or 2 or a polymeric form of such a compound, where R is an alkyl radical, n and x are each integers from 1 to 4, and the average number of carbon atoms in all of the R groups is at least about 9 in order to ensure adequate solubility in oil. The individual R groups may each contain from 5 to 40, preferably 8 to 20, carbon atoms. The metal salt is prepared by reacting an alkyl phenol sulfide with a sufficient quantity of metal containing material to impart the desired alkalinity to the sulfurized metal phenate.

Regardless of the manner in which they are prepared, the sulfurized alkylphenols which are useful contain from about 2 to about 14% by weight, preferably about 4 to about 12 wt % sulfur based on the weight of sulfurized alkylphenol.

The sulfurized alkyl phenol is converted by reaction with a metal containing material including oxides, hydroxides and complexes in an amount sufficient to neutralize said phenol and if desired, to overbase the product to a desired alkalinity by procedures well known in the art. Preferred is a process of neutralization utilizing a solution of metal in a glycol ether.

The neutral or normal sulfurized metal phenates are those in which the ratio of metal to phenol nucleus is about 1:2. The "overbased" or "basic" sulfurized metal phenates are sulfurized metal phenates wherein the ratio of metal to phenol is greater than that of stoichiometry, e.g. basic sulfurized metal dodecyl phenate has a metal content up to and greater than 100% in excess of the metal present in the corresponding normal sulfurized metal phenates wherein the excess metal is produced in oil-soluble or dispersible form (as by reaction with $CO_2$).

Magnesium and calcium containing additives although beneficial in other respects can increase the tendency of the lubricating oil to oxidise. This is especially true of the highly basic sulphonates.

According to a preferred embodiment the invention therefore provides a crankcase lubricating composition containing a major amount of lubricating oil, and (1) a dispersant selected from the group consisting of:
(a) 1 to 10 wt % ashless dispersant compounds,
(b) 0.3 to 10% of a polymeric viscosity index improver dispersant group,
(2) from 0.01 to 0.5 wt % phosphorus,
(3) from 0.01 to 0.5 wt % zinc,
(4) from 5 to 500 parts per million of copper,
(5) from 2 to 8000 parts per million of calcium or magnesium. These compositions of our invention may also contain other additives such as those previously described, and other metal containing additives, for example, those containing barium and sodium.

The magnesium and/or calcium is generally present as basic or neutral detergents such as the sulphonates and phenates, our preferred additives are the neutral or basic magnesium or calcium sulphonates. preferably the oils contain from 500 to 5000 parts per million of calcium or magnesium. Basic magnesium and calcium sulfonates are preferred.

The lubricating composition of the present invention may also include copper lead bearing corrosion inhibitors. Typical of such compounds are the thiadiazole polysulphides containing from 5 to 50 carbon atoms, their derivatives and polymers thereof. Preferred materials are the derivatives of 1,3,4 thiadiazoles such as those described in U.S. Pat. Nos. 2,719,125, 2,719,126 and 3,087,932 especially preferred is the compound 2,5 bis (t-octadithio)-1,3,4 thiadiazole commercially available as Amoco 150. Other similar materials also suitable are described in U.S. Pat. Nos. 3,821,236, 3,904,537, 4,097,387, 4,107,059, 4,136,043, 4,188,299 and 4,193,882.

Other suitable additives are the thio and polythio sulphenamides of thiadiazoles such as those described in U.K. Patent Specification 1,560,830. When these compounds are included in the lubricating composition we prefer that they be present in an amount from 0.01 to 10 preferably 0.1 to 5.0 weight percent based on the weight of the composition. Surprisingly the presence of such copper lead bearing corrosion inhibitors has generally been found out to inhibit the antioxidant effect of the copper.

Additives for lubricating oils are generally supplied as concentrates in oil for incorporation into the bulk lubricant. The present invention therefore provides concentrates comprising an oil solution containing:

(1) a dispersant selected from the group consisting of:
(a) 0 to 40, e.g. 10 to 60 wt % of an ashless dispersant compound,
(b) 0 to 40, e.g. 3 to 40% of a polymeric viscosity index improver dispersant,
(2) from 0.1 to 10 wt % of phosphorus,
(3) from 0.1 to 10 wt % of zinc,
(4) from 0.005 to 2 weight percent of copper.

The concentrate may also contain other additives such as the detergents and viscosity index improvers previously described. A particularly preferred concentrate also contains a magnesium or calcium containing additive and the invention therefore also provides a concentrate comprising an oil solution containing (1) a dispersant selected from the group consisting of:
(a) 0 to 60, e.g. 10 to 60 wt % of an ashless dispersant compound,
(b) 0 to 40, e.g. 3 to 40% of a polymeric viscosity index improver dispersant,
(2) from 0.1 to 10 wt % of phosphorus,
(3) from 0.1 to 10 wt % of zinc,
(4) from 0.005 to 2 weight percent of copper,
(5) from $8\times10^{-3}$ to $8\times10^{-4}$ ppm of calcium and/or magnesium.

The present invention is illustrated but in no way limited by reference to the following Examples.

EXAMPLE 1

A 10W/30 lubricating oil containing a major amount of a mineral lubricating oil composition and 4.8 wt % of an about 50 wt % active ingredient concentrate of a dispersant mixture of a polyisobutenyl succinic anhydride reacted with polyethylene amine and then borated, together with a polyisobutenyl succinic anhydride reacted with trishydroxy methyl amino methane, as described in U.S. Pat. No. 4,113,639, 1.0 wt % of a 400 TBN (Total Base Number) magnesium sulphonate containing 9.2 wt % magnesium, 0.3 wt % of a 250 TBN calcium phenate containing 9.3 wt % of calcium, and 7.9 wt % of a viscosity index improver concentrate containing 10 wt % of an ethylene/propylene copolymer and 4 wt % of a vinyl acetate/fumarate copolymer as pour depressant. To this was added a zinc dialkyl dithiophosphate concentrate (75 wt % active ingredient (a.i.) in diluent mineral oil) in which the alkyl groups were a mixture of such groups having between about 4 and 5 carbon atoms and made by reacting $P_2S_5$ with a mixture of about 65% isobutyl alcohol and 35% of amyl alcohol; to give a phosphorus level of 0.1 wt % in the lubricating oil composition. The oxidation stability of this oil composition was tested by oxidising a 300 gram sample of the oil composition containing 40 parts per million of iron as ferric acetylacetonate by passing 1.7 liters of air per minute through the sample at 165° C. and determining the viscosity at intervals up to 64 hours on a Ferranti-Shirley cone-on-plate-viscometer. In this test the oil composition is just about to turn solid when a viscosity of about 5 poise is reached.

The oxidation stability of the oil composition was compared with the oil compositions containing additive compounds which were well known supplementary antioxidants and with the oil compositions containing certain copper additives in addition to the zinc dialkyl dithiophosphate with the results shown in Table 1.

TABLE 1

| Additional Compound | wt % | Copper (ppm) | Time Tested Hours | Viscosity (poise) |
|---|---|---|---|---|
| None | — | — | 30 | Solid |
| Phenyl-l-naphthylamine | 0.5 | — | 24 | " |
| Alkylated Diphenylamine ("Octamine") | 0.5 | — | 40 | " |
| Methylene bridged sterically hindered phenol | 0.5 | — | 30 | " |
| Sulphurised nonyl phenol | 1.0 | — | 64 | 5 |
| Extra zinc dialkyl dithiophosphate | 1.2 | — | 48 | 5 |
| Extra zinc dialkyl dithiophosphate | 1.2 | — | 64 | Solid |

TABLE 1-continued

| Additional Compound | wt % | Copper (ppm) | Time Tested Hours | Viscosity (poise) |
|---|---|---|---|---|
| Cuprous diaryl dithiophosphate | 0.23 | 170 | 64 | 3.7 |
| Cuprous disecondary hexyl dithiophosphate | 0.10 | 170 | 64 | 3.1 |
| Cuprous di-isoctyl dithiophosphate | 0.13 | 170 | 64 | 3.1 |
| Cupric naphthenate | 0.25 | 170 | 64 | 3.3 |
| Cupric oleate | 0.32 | 160 | 64 | 3.0 |
| Cupric dithiocarbamate | 0.12 | 145 | 64 | 4.1 |

EXAMPLE 2

Various mineral lubricating oil compositions were prepared containing a major amount of a mineral lubricating oil obtained from an average quality mineral lubricating oil basestock, 5.4 wt % of the concentrate of the dispersant mixture of Example 1, the other additives of Example 1 and the following amounts of the zinc compound of Example 1, together with various added copper compounds.

| Zinc Compound | wt % (concentrate) | Copper Compound | wt % | PPM Cu in Oil |
|---|---|---|---|---|
| A | 1.80 | Cupric Naphthenate | 1.50 | 1200 |
| B | 1.48 | Cuprous di-isooctyl-dithiophosphate | 0.39 | 486 |
| C | 1.65 | Cuprous di-isooctyl-dithiophosphate | 0.20 | 240 |
| D | 1.70 | Cuprous disecondary hexyl-dithiophosphate | 0.084 | 120 |
| E | 1.80 | Cupric oleate | 0.156 | 94 |

The lubricating oil compositions described above were tested in the Sequence 3D test ASTM publication STP 315G.

The increase in the viscosity of the oil composition and the wear of the cam and lifters in the engine in relation to the parts per million of copper in the oil composition are shown in the accompanying FIG. 1.

The lubricating oil composition containing 1.80 wt % of the zinc compound mentioned above and no copper additive was too viscous to measure after 48 hours.

EXAMPLE 3

Figure 2:
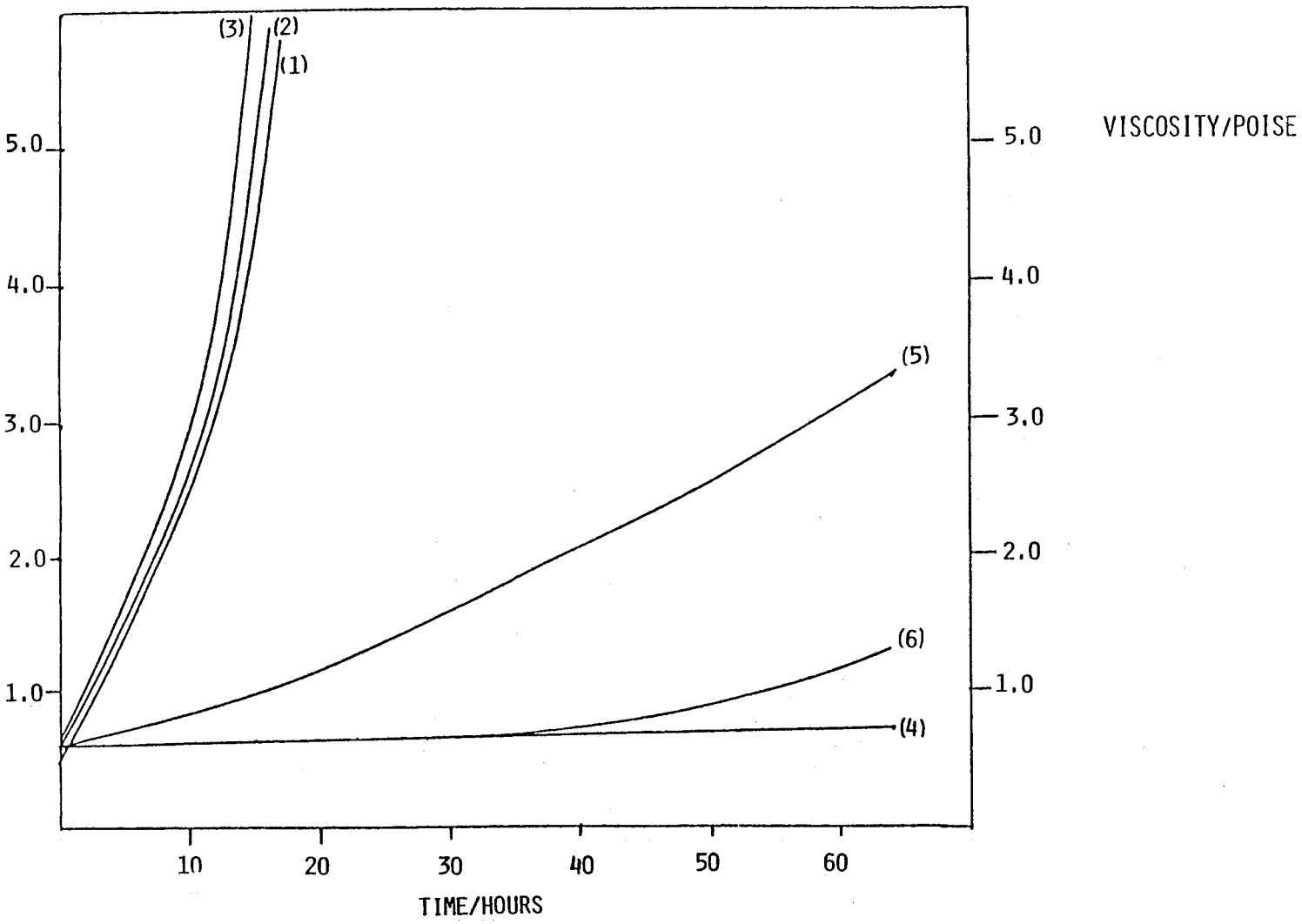
FIG. 2 is a graphical plot of oil viscosity against time for certain of the crankcase mineral lubricating oil compositions of Example 3.

The effect of various additives on the oxidation stability of a 10W/30 crankcase mineral lubricating oil composition was measured using the oxidation test described in Example 1. The results are shown in Table 2 and a plot of oil viscosity against time for oils (1)–(6) is shown in FIG. 2, the numbers of the curves corresponding to those of Table 2.

The additives used were as follows:

(A) is a viscosity index improver concentrate containing 10 wt % of an ethylene/propylene copolymer and 4% of a vinyl acetate/fumarate copolymer, (B) is a dispersant concentrate containing about 50 wt % of mineral oil and about 50 wt % of a polyisobutenyl succinic anhydride-polyamine condensation product that has been treated with a boron compound so that the concentrate contains 1.58 wt % N and 0.35 wt % B, (C) is the zinc dialkyldithiophosphate concentrate used in Example 1, (D) is a 400 TBN magnesium sulphonate containing 9.2 wt % of magnesium, (E) is a 400 TBN calcium sulphonate containing 15.3 wt % of calcium, (F) is cupric oleate, (G) is 2,5-bis (t-octadithio)-1,3,4 thiadiazole.

EXAMPLE 4

Figure 3:
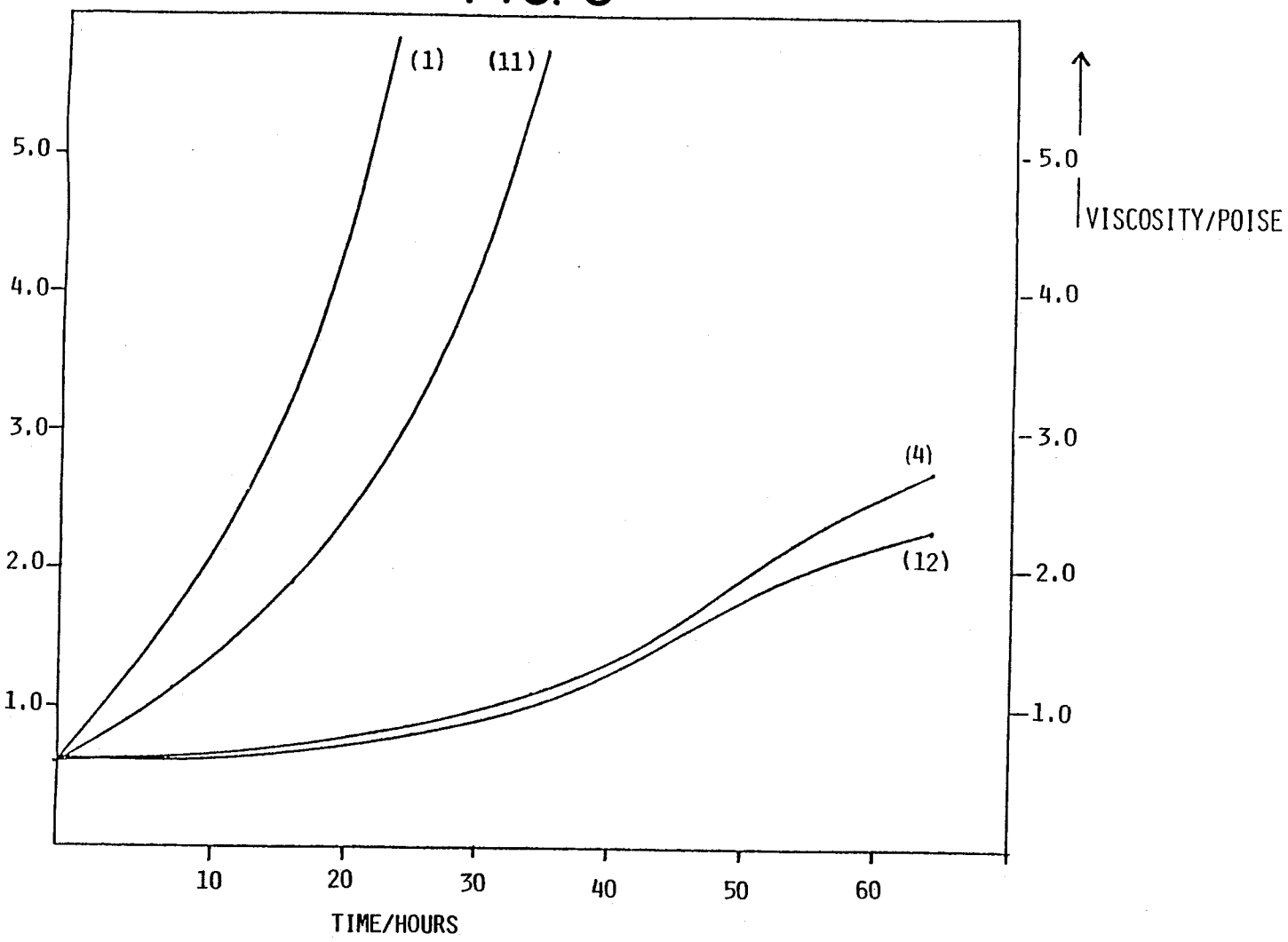
FIG. 3 is a plot of oil viscosity against time for certain of the crankcase mineral lubricating oils of Example 4.

Using the additives of Example 2 the effect of different concentrations of copper on the oxidative stability was measured using the oxidation test described in Example 1. The results are shown in Table 3 and a plot of oil viscosity against time for oils (1), (4), (11), and (12) of Table 3 is shown in FIG. 3.

TABLE 2

| Additive | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| A/wt % | — | 7.9 | → | → | → | → | → | → | → | → | → | → | → | → |
| B/wt % | — | — | 4.5 | — | 4.5 | → | → | → | → | → | → | → | → | → |
| C/wt % | — | — | — | 0.5 | → | → | → | → | → | → | → | → | → | → |
| D/wt % | — | — | — | — | — | — | 1.0 | — | 1.0 | — | 1.0 | 1.0 | — | — |
| E/wt % | — | — | — | — | — | — | — | 1.0 | — | 1.0 | — | — | 1.0 | 1.0 |
| F/ppm of Cu | — | — | — | — | — | 120 | — | — | 120 | 120 | — | 120 | — | 120 |
| G/wt % | — | — | — | — | — | — | — | — | — | — | 0.1 | 0.1 | 0.1 | 0.1 |
| Viscosity/poise | 4.9 | 5.0 | >5.0 | 0.7 | 3.3 | 1.3 | >5.0 | >5.0 | 2.7 | 2.3 | >5.0 | 3.9 | >5.0 | 2.2 |
| Length of test/hrs | 16 | 16 | 24 | 64 | 64 | 64 | 40 | 40 | 64 | 64 | 40 | 64 | 40 | 64 |

TABLE 3

| Additive | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| A/wt % | 7.9 | → | → | → | → | → | → | → | → | → | → | → | → | → |
| B/wt % | 4.5 | → | → | → | → | → | → | → | → | → | → | → | | |
| C/wt % | 0.5 | 0.5 | 0.5 | 0.5 | 0.5 | 1.3 | 1.3 | 1.3 | 2.0 | 2.0 | 0.5 | 0.5 | 1.3 | 1.3 |
| D/wt % | 1.0 | → | → | → | → | → | → | → | → | → | — | — | — | — |
| E/wt % | — | — | — | — | — | — | — | — | — | — | 1.0 | 1.0 | 1.0 | 1.0 |
| F/ppm of Cu | 0.0 | 70 | 110 | 120 | 200 | 0 | 120 | 200 | 0 | 120 | 0 | 120 | 0 | 120 |
| Viscosity/ | >5.0 | >5.0 | 4.7 | 2.7 | 2.2 | >5.0 | 2.5 | 2.4 | 4.7 | 1.4 | >5.0 | 2.3 | 4.0 | 2.1 |

TABLE 3-continued

| Additive | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| poise | | | | | | | | | | | | | | |
| Length of test/hrs. | 40 | 40 | 64 | 64 | 64 | 40 | 64 | 64 | 40 | 64 | 40 | 64 | 64 | 64 |

What we claim is:

1. A lubricating oil composition suitable as a crankcase lubricant in internal combustion engines comprising:

A. a major amount of lubricating oil;

B. a dispersing amount of lubricating oil dispersant selected from the group consisting of:

(1) ashless nitrogen or ester containing dispersant compounds selected from the group consisting of:

(a) oil soluble salts, amides, imides, oxazolines, esters, and mixtures thereof, of long chain hydrocarbon substituted mono- and dicarboxylic acids or their anhydrides;

(b) long chain aliphatic hydrocarbons having a polyamine attached directly thereto; and (c) Mannich condensation products formed by condensing about a molar proportion of long chain hydrocarbon substituted phenol with from about 1 to 2.5 moles of formaldehyde and from about 0.5 to 2 moles of polyalkylene polyamine; wherein said long chain hydrocarbon group is a polymer of a $C_2$ to $C_5$ monoolefin, said polymer having a molecular weight of from about 700 to about 5000;

(2) nitrogen or ester containing polymeric viscosity index improver dispersants which are selected from the group consisting of:

(a) polymers comprised of $C_4$ to $C_{24}$ unsaturated esters of vinyl alcohol or of $C_3$ to $C_{10}$ unsaturated mono- or dicarboxylic acid with unsaturated nitrogen containing monomers having 4 to 20 carbons, (b) copolymers of $C_2$ to $C_{20}$ olefin with $C_3$ to $C_{10}$ mono- or dicarboxylic acid neutralized with amine, hydroxy amine or alcohols, and (c) polymers of ethylene with a $C_3$ to $C_{20}$ olefin further reacted either by grafting $C_4$ to $C_{20}$ unsaturated nitrogen containing monomers thereon or by grafting an unsaturated acid onto the polymer backbone and then reacting said carboxylic acid groups with amine, hydroxy amine or alcohol; and (3) mixtures of (1) and (2); wherein when said lubricating oil dispersant (1) is present, then said dispersing amount of (1) is about 1 to 10 wt. %, and when said lubricating oil dispersant (2) is present, then said dispersing amount of (2) is from about 0.3 to 10 wt. %;

C. from about 0.01 to 5.0 parts by weight of oil soluble zinc dihydrocarbyl dithiophosphate wherein the hydrocarbyl groups contain from 1 to 18 carbon atoms;

D. an antioxidant effective amount, within the range of from about 5 to about 500 parts per million by weight, of added copper in the form of an oil soluble copper compound; and E. a lubricating oil detergent additive which comprises at least one magnesium or calcium salt of a material selected from the group consisting of sulfonic acids, alkyl phenols, sulfurized alkyl phenols, alkyl salicylates and naphthenates, wherein said parts by weight are based upon 100 parts by weight of said lubricating composition and said weight % is based on the weight of said lubricating composition.

2. A lubricating composition according to claim 1, wherein said composition contains from about 60 to about 200 parts per million by weight of said copper.

3. A lubricating composition according to claim 1, wherein said zinc dihydrocarbyl dithiophosphate comprises zinc dialkyl dithiophosphate wherein said alkyl group each contain from 2 to 8 carbon atoms, with the total number of carbon atoms in the alkyl groups of each said dithiophosphate moiety being 5 or more.

4. A lubricating composition according to claim 3, wherein said composition contains from 0.2 to 2.0 parts of zinc dihydrocarbyl dithiophosphate and 80 to 180 parts per million of said copper.

5. A lubricating composition according to claim 1, wherein said composition contains from 0.3 to 10 wt. % of said polymeric viscosity index improver dispersant.

6. A lubricating composition according to claim 1, wherein said composition contains from 1 to 10 wt. % of ashless dispersant compound which comprises a nitrogen containing derivative of an alkenyl succinic acid or anhydride, an ester of alkenyl succinic acid or anhydride derived from monohydric alcohols, polyhydric alcohols, phenols or naphthols or mixtures thereof.

7. A lubricating composition according to claim 6, wherein said ashless dispersant compound comprises the reaction product selected from the group consisting of polyisobutenyl succinic anhydride reacted with polyethylene amine, polyisobutenyl succinic anhydride reacted with polyethylene amine and then further treated with a boron compound, polyisobutenyl succinic anhydride reacted with tris-hydroxymethyl amino methane, and mixtures thereof.

8. A lubricating composition according to claim 6, wherein said dispersant comprises polyisobutenyl succinic anhydride reacted with polyhydric alcohols containing from 2 to about 10 hydroxy radicals.

9. A lubricating composition according to claim 8, wherein said polyhydric alcohol comprises a member selected from the group consisting of glycerol, glycerol mono-oleate, glycerol mono-stearate, glycerol monomethyl ether and pentaerythritol.

10. A lubricating composition according to claim 1, wherein said detergent additive is present in an amount sufficient to provide from 500 to 5000 parts per million by weight of calcium or magnesium in said lubricating composition.

11. A lubricating composition according to claim 10, wherein said detergent additive comprises at least one member selected from the group consisting of neutral and basic magnesium phenates, neutral and basic magnesium sulphonates and mixtures thereof.

12. A lubricating composition according to claim 10, wherein said detergent additive comprises at least one member selected from the group consisting of neutral and basic calcium phenates, neutral and basic calcium sulphonates and mixtures thereof.

13. A lubricating oil composition according to claim 10, wherein said detergent additive comprises a basic magnesium or calcium sulfonate.

14. A lubricating composition according to any one of claims 1–13, wherein said copper compound comprises at least one member selected from the group consisting of copper dihydrocarbyl thiophosphates and copper dihydrocarbyl dithiophosphates.

15. A lubricating composition according to claim 14, wherein said copper compound comprises at least one member selected from the group consisting of cuprous diaryl dithiophosphate, cuprous di-secondary hexyl dithiophosphate and cuprous di-isooctyl dithiophosphate.

16. A lubricating composition according to any one of claims 1–13, wherein said copper compound comprises at least one member selected from the group consisting of copper salts of $C_{10}$ to $C_{18}$ fatty acids.

17. A lubricating composition according to claim 16, wherein said copper compound comprises copper stearate or copper palmitate.

18. A lubricating composition according to any one of claims 1–13, wherein said compound comprises at least one member selected from the group consisting of copper salts of naphthenic acids having a molecular weight of from 200 to 500.

19. A lubricating composition according to claim 18, wherein said copper compound comprises cupric naphthenate.

20. A lubricating composition according to any one of claims 1–13, wherein said copper compound comprises at least one member selected from the group consisting of copper dithiocarbamates of the formula $(RR'NCSS)_nCu$, wherein n is 1 or 2 and R and R' are hydrocarbon radicals containing from 1 to 18 carbon atoms.

21. A lubricating composition according to claim 20, wherein said copper compound comprises cupric dithiocarbamate.

22. A lubricating composition according to any one of claims 1–13, wherein said copper compound comprises at least one copper salt of a natural or synthetic carboxylic acid.

23. A lubricating composition according to claim 22, wherein said copper compound comprises cupric oleate.

24. A lubricating composition according to any one of claims 1–13, wherein said copper compound comprises a member selected from the group consisting of copper sulfonates, copper phenates and copper acetylacetonates.

25. A lubricating crankcase motor oil composition for internal combustion engines comprises a major amount of lubricating oil; from 1 to 10 wt. % of an ashless nitrogen or ester containing dispersant compound formed by reacting alkenyl succinic acid or anhydride with a member selected from the group consisting of polyamine, amine alcohol, polyol and mixtures thereof, wherein said alkenyl group is a polymer of from 700 to 5000 molecular weight of $C_2$ to $C_5$ monoolefin; from 0.01 to 5.0 parts by weight of an oil soluble zinc dihydrocarbyl dithiophosphate wherein said hydrocarbyl groups contain from 1 to 18 carbons; an antioxidant effective amount, in the range of from about 5 to about 500 parts per million, of added copper in the form of an oil soluble copper compound; and a lubricating oil detergent additive which comprises at least one magnesium or calcium salt of a material selected from the group consisting of sulfonic acids, alkyl phenols, sulfurized alkyl phenols, alkyl salicylates, and naphthenates, wherein said parts by weight are based upon 100 parts by weight of said lubricating composition and said weight % is based on the weight of said lubricating composition.

26. A lubricating composition according to claim 25, wherein said composition contains from about 60 to about 200 parts per million by weight of said copper.

27. A lubricating composition according to claim 25, wherein said zinc dihydrocarbyl dithiophosphate comprises zinc dialkyl dithiophosphate wherein said alkyl groups each contain from 2 to 8 carbon atoms, with the total number of carbon atoms in the alkyl groups of each said dithiophosphate moiety being 5 or more.

28. A lubricating composition according to claim 27, wherein said composition contains from 0.2 to 2.0 parts of zinc dihydrocarbyl dithiophosphate and 80 to 180 parts per million of said copper.

29. A lubricating composition according to claim 25, wherein said composition contains from 1 to 10 wt. % of ashless dispersant compound which comprises a nitrogen containing derivative of an alkenyl succinic acid or anhydride, an ester of alkenyl succinic acid or anhydride derived from monohydric alcohols, polyhydric alcohols, phenols or naphthols or mixtures thereof.

30. A lubricating composition according to claim 29, wherein said ashless dispersant compound comprises the reaction product selected from the group consisting of polyisobutenyl succinic anhydride reacted with polyethylene amine, polyisobutenyl succinic anhydride reacted with polyethylene amine and then further treated with a boron compound, polyisobutenyl succinic anhydride reacted with tris-hydroxymethyl amino methane, and mixtures thereof.

31. A lubricating composition according to claim 29, wherein said dispersant comprises polyisobutenyl succinic anhydride reacted with polyhydric alcohols containing from 2 to about 10 hydroxy radicals.

32. A lubricating composition according to claim 31, wherein said polyhydric alcohol comprises a member selected from the group consisting of glycerol, glycerol mono-oleate, glycerol mono-stearate, glycerol monomethyl ether and pentaerythritol.

33. A lubricating composition according to claim 25, wherein said metal detergent additive is present in an amount sufficient to provide from 500 to 5000 parts per million by weight of calcium or magnesium in said lubricating composition.

34. A lubricating composition according to claim 33, wherein said metal detergent additive comprises at least one member selected from the group consisting of neutral and basic magnesium phenates, neutral and basic magnesium sulphonates and mixtures thereof.

35. A lubricating composition according to claim 33, wherein said metal detergent additive comprises at least one member selected from the group consisting of neutral and basic calcium phenates, neutral and basic calcium sulphonates and mixtures thereof.

36. A lubricating oil composition according to claim 34, wherein said detergent additive comprises a basic magnesium or calcium sulfonate.

37. A lubricating composition according to any one of claims 25–36, wherein said copper compound comprises at least one member selected from the group consisting of copper dihydrocarbyl thiophosphates and copper dihydrocarbyl dithiophosphates.

38. A lubricating composition according to any one of claims 25–36, wherein said copper compound comprises at least one member selected from the group consisting of cuprous diaryl dithiophosphate, cuprous di-secondary hexyl dithiophosphate and cuprous di-isooctyl dithiophosphate.

39. A lubricating composition according to any one of claims 25–36, wherein said copper compound comprises at least member selected from the group consisting of copper salts of $C_{10}$ to $C_{18}$ fatty acids.

40. A lubricating composition according to claim 39, wherein said copper compound comprises copper stearate or copper palmitate.

41. A composition according to any one of claims 25–36, wherein said copper compound comprises at least one member selected from the group consisting of copper salts of naphthenic acids having a molecular weight of from 200 to 500.

42. A lubricating composition according to claim 41, wherein said copper compound comprises cupric naphthenate.

43. A lubricating composition according to any one of claims 25–36, wherein said copper compound comprises at least one member selected from the group consisting of copper dithiocarbamates of the formula $(RR'NCSS)_nCu$, wherein n is or 2 and R and R' are hydrocarbon radicals containing from 1 to 18 carbon atoms.

44. A lubricating composition according to claim 43, wherein said copper compound comprises cupric dithiocarbamate.

45. A lubricating composition according to any one of claims 25–36, wherein said copper compound comprises at least one copper salt of a natural or synthetic carboxylic acid.

46. A lubricating composition according to claim 45, wherein said copper compound comprises cupric oleate.

47. A lubricating composition according to any one of claims 25–36, wherein said copper compound comprises a member selected from the group consisting of copper sulfanates, copper phenates and copper acetylacetonates.

48. A lubricating oil composition suitable as a crankcase motor oil for internal combustion engines which comprises a major amount of mineral lubricating oil, from 1 to 10 wt. % of dispersant which comprises at least one of (1) polyisobutenyl succinic anhydride reacted with polyethyleneamine and (2) polyisobutenyl succinic anhydride reacted with polyethyleneamine and then borated; from 0.2 to 2 . 0 p arts by weight o f zinc dihydrocarbyl dithiophosphate wherein said hydrocarbyl groups are a mixture of alkyl groups of 4 and 5 carbon atoms; an antioxidant effective amount within the range of from about 60 to about 200 parts per million by weight of added copper in the form of an oil-soluble copper compound in said lubricating composition; and a detergent additive comprising at least one of an overbased magnesium sulfonate, an overbased calcium sulfonate, an overbased magnesium phenate and an overbased calcium phenate in an amount sufficient to provide from 500 to 5000 parts per million by weight of said magnesium or calcium, wherein said parts by weight are based upon 100 parts by weight of said lubricating composition and said weight % is based on the weight of said lubricating composition.

49. A lubricating composition according to claim 48, wherein said copper compound comprises at least one member selected from the group consisting of copper dihydrocarbyl thiophosphates and copper dihydrocarbyl dithiophosphates.

50. A lubricating composition according to claim 49, wherein said copper compound comprises at least one member selected from the group consisting of cuprous diaryl dithiophosphate, cuprous di-secondary hexyl dithiophosphate and cuprous di-isooctyl dithiophosphate.

51. A lubricating composition according to claim 48, wherein said copper compound comprises at least one member selected from the group consisting of copper salts of $C_{10}$ to $C_{18}$ fatty acids.

52. A lubricating composition according to claim 51, wherein said copper compound comprises copper stearate or copper palmitate.

53. A lubricating composition according to claim 48, wherein said copper compound comprises at least one member selected from the group consisting of copper salts of naphthenic acids having a molecular weight of from 200 to 500.

54. A lubricating composition according to claim 53, wherein said copper compound comprises cupric naphthenate.

55. A lubricating composition according to claim 48, wherein said copper compound comprises at least one member selected from the group consisting of and copper dithiocarbamates of the formula $(RR'NCSS)_nCu$, wherein n is 1 or 2 and R and R' are hydrocarbon radicals containing from 1 to 18 carbon atoms.

56. A lubricating composition according to claim 55, wherein said copper compound comprises cupric dithiocarbamate.

57. A lubricating composition according to claim 48, wherein said copper compound comprises at least one copper salt of a natural or synthetic carboxylic acid.

58. A lubricating composition according to claim 48, wherein said copper compound comprises cupric oleate.

59. A lubricating composition according to claim 57, wherein said copper compound comprises a member selected from the group consisting of copper sulfonates, copper phenates and copper acetylacetonates.

60. A lubricating composition according to any one of claims 48–59 wherein said polyisobutenyl moiety is derived from polyisobutylene having a molecular weight of from 700 to 5000.

61. A lubricating oil concentrate composition suitable for use in preparing crankcase lubricants for internal combustion engines which comprises:

A. lubricating oil;

B. at least one lubricating oil dispersant selected from the group consisting of:

(1) ashless nitrogen or ester containing dispersant compounds selected from the group consisting of:

(a) oil soluble salts, amides, imides, oxazolines, esters, and mixtures thereof, of long chain hydrocarbon substituted mono- and dicarboxylic acids or their anhydrides;

(b) long chain aliphatic hydrocarbons having a polyamine attached directly thereto; and (c) Mannich condensation products formed by condensing about a molar proportion of long chain hydrocarbon substituted phenol with from about to 2.5 moles of formaldehyde and about from 0.5 to 2 moles of polyalkylene polyamine; wherein said long chain hydrocarbon group is a polymer of a $C_2$ to $C_5$ monoolefin, said polymer having a molecular weight of from about 700 to about 5000;

(2) nitrogen or ester containing polymeric viscosity improver dispersants which are selected from the group consisting of:

(a) polymers comprised of $C_4$ to $C_{24}$ unsaturated of vinyl alcohol or of $C_3$ to $C_{10}$ unsaturated mono- or dicarboxylic acid with unsaturated nitrogen containing monomers having 4 to 20 carbons.

(b) copolymers of $C_2$ to $C_{20}$ olefin with $C_3$ to $C_{10}$ mono- or dicarboxylic acid neutralized with amine, hydroxy amine or alcohols, and (c) polymers of ethylene with a $C_3$ to $C_{20}$ olefin fu reacted either by grafting $C_4$ to $C_{20}$ unsaturated nitrogen containing monomers thereon or by grafting an unsaturated acid onto the polymer backbone and then reacting said carboxylic acid groups with amine, hydroxy amine or alcohol; and (3) mixtures of (1) and (2); wherein when said lubricating oil dispersant (1) is present, then said dispersing amount of (1) is about 10 to 60 wt. %, and when said lubricating oil dispersant (2) is present, then said dispersing amount of (2) is from about 3 to 40 wt. %;

C. oil soluble zinc dihydrocarbyl dithiophosphate wherein the hydrocarbyl groups contain from 1 to 18 carbon atoms and said dithiophosphate provides from 0.1 to 10.0 wt. % phosphorus and from 0.1 to 10.0 wt. % zinc;

D. added copper, within the range of from 0.005 to 2 weight percent, in the form of an oil soluble copper compound; and E. a magnesium or calcium containing lubricating oil detergent additive which comprises at least one magnesium or calcium salt of a material selected from the group consisting of sulfonic acids, alkyl phenols, sulfurized alkyl phenols, alkyl salicylates, and naphthenates, wherein said parts by weight are based upon 100 parts by weight of said lubricating concentrate and said weight % is based on the weight of said lubricating concentrate.

62. A lubricating oil concentrate composition according to claim 61, wherein said composition contains from 10 to 60 wt. % of ashless dispersant compound which comprises a nitrogen containing derivative of an alkenyl succinic acid or anhydride, an ester of said alkenyl succinic acid or anhydride derived from monohydric and polyhydric alcohols, phenols and naphthols or mixtures thereof.

63. A lubricating composition according to claim 61, wherein said zinc dihydrocarbyl dithiophosphate comprises zinc dialkyl dithiophosphate wherein said alkyl groups each contain from 2 to 8 carbon atoms, with the total number of carbon atoms in the alkyl groups of each said dithiophosphate moiety being 5 or more.

64. A lubricating composition according to claim 61, wherein said composition contains from 0.3 to 10 wt. % of said polymeric viscosity index improver dispersant.

65. A lubricating composition according to claim 62, wherein said ashless dispersant compound comprises the reaction product selected from the group consisting of polyisobutenyl succinic anhydride reacted with polyethylene amine, polyisobutenyl succinic anhydride reacted with polyethylene amine and then further treated with a boron compound, polyisobutenyl succinic anhydride reacted with tris-hydroxymethyl amino methane, and mixtures thereof.

66. A lubricating composition according to claim 62, wherein said dispersant comprises polyisobutenyl succinic anhydride reacted with a polyhydric alcohol comprising a member selected from the group consisting of glycerol, glycerol mono-oleate, glycerol mono-stearate, glycerol monomethyl ether and pentaerythritol.

67. A lubricating composition according to claim 62, wherein said detergent additive is present in an amount sufficient to provide from 500 to 5000 parts per million by weight of calcium or magnesium in said lubricating composition.

68. A lubricating composition according to claim 67, wherein said detergent additive comprises at least one member selected from the group consisting of neutral and basic magnesium phenates, neutral and basic magnesium sulphonates and mixtures thereof.

69. A lubricating composition according to claim 67, wherein said detergent additive comprises at least one member selected from the group consisting of neutral and basic calcium phenates, neutral and basic calcium sulphonates and mixtures thereof.

70. A lubricating composition according to claim 67, wherein said detergent additive comprises a basic magnesium or calcium sulfonate.

71. A lubricating composition according to claim 67, wherein said detergent additive-is sulfurized.

72. A lubricating composition according to any one of claims 61–71, wherein said copper compound comprises at least one member selected from the group consisting of copper dihydrocarbyl thiophosphates and copper dihydrocarbyl dithiophosphates.

73. A lubricating composition according to claim 72, wherein said copper compound comprises at least one member selected from the group consisting of cuprous diaryl dithiophosphate, cuprous di-secondary hexyl dithiophosphate and cuprous di-isooctyl dithiophosphate.

74. A lubricating composition according to any one of claims 61–71, wherein said copper compound comprises at least one member selected from the group consisting of copper salts of $C_{10}$ to $C_{18}$ fatty acids.

75. lubricating composition according to claim 74, wherein said copper compound comprises copper stearate or copper palmitate.

76. A lubricating composition according to any one of claims 61–71, wherein said copper compound comprises at least one member selected from the group consisting of copper salts of naphthenic acids having a molecular weight of from 200 to 500.

77. A lubricating composition according to claim 76, wherein said copper compound comprises cupric naphthenate.

78. A lubricating composition according to any one of claims 61–71, wherein said copper compound comprises at least one member selected from the group consisting of copper dithiocarbamates of the formula $(RR'NCSS)_nCu$, wherein n is 1 or 2 and R and R' are hydrocarbon radicals containing from 1 to 18 carbon atoms.

79. A lubricating composition according to claim 78, wherein said copper compound comprises cupric dithiocarbamate.

80. A lubricating composition according to any one of claims 61–71, wherein said copper compound comprises at least one copper salt of a natural or synthetic carboxylic acid.

81. A lubricating composition according to claim 80, wherein said copper compound comprises cupric oleate.

82. A lubricating composition according to any one of claims 61–71, wherein said copper compound comprises a member selected from the group consisting of copper sulfonates, copper phenates and copper acetylacetonates.

* * * * *